US009214295B2

(12) United States Patent
Wu et al.

(10) Patent No.: US 9,214,295 B2
(45) Date of Patent: Dec. 15, 2015

(54) KEY STRUCTURE

(71) Applicant: Primax Electronics Ltd., Neihu, Taipei (TW)

(72) Inventors: Chu-Hsun Wu, Taipei (TW); Hsien-Tsan Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 76 days.

(21) Appl. No.: 14/104,418

(22) Filed: Dec. 12, 2013

(65) Prior Publication Data

US 2015/0047959 A1 Feb. 19, 2015

(30) Foreign Application Priority Data

Aug. 16, 2013 (TW) ..... 102129497 A

(51) Int. Cl.
*H01H 13/70* (2006.01)
*H01H 3/12* (2006.01)

(52) U.S. Cl.
CPC ..... *H01H 3/125* (2013.01)

(58) Field of Classification Search
CPC ..... H01H 9/26; H01H 13/72; H01H 13/76; H01H 9/00; H01H 3/48; H01H 13/70; H01H 1/06; H01H 3/12; H01H 1/60; H01H 2227/032; H01H 2227/034; H01H 13/84; H01H 13/85; H01H 35/00; H01H 35/2614; H01H 35/2621; H01H 35/2628; H01H 35/2685; H01H 2211/032
See application file for complete search history.

(56) References Cited

U.S. PATENT DOCUMENTS 7,841,791 B2 * 11/2010 Iso ..... 400/491.2
2008/0047817 A1 * 2/2008 Hou et al. ..... 200/517
2009/0058802 A1 * 3/2009 Orsley ..... 345/157

FOREIGN PATENT DOCUMENTS

WO WO 2007114631 A2 * 10/2007

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

A key structure includes a base plate, a switch circuit board, a keycap, and an enclosure frame. The keycap includes a magnetic element. The magnetic element is disposed on an edge part of the keycap. The enclosure frame includes a magnetic coating layer. The magnetic coating layer is formed on an edge part of the enclosure frame and disposed over the magnetic element. When the keycap is depressed, the keycap is moved to trigger the switch circuit board, so that the switch circuit board generates a key signal. When the keycap is no longer depressed, the keycap is moved toward the magnetic coating layer in response to the magnetic force. The key structure can be normally operated without the need of installing an elastic rubbery element.

10 Claims, 5 Drawing Sheets

KEY STRUCTURE

FIELD OF THE INVENTION

The present invention relates to a key structure, and more particularly to a key structure for use in a keyboard device.

BACKGROUND OF THE INVENTION

Nowadays, computers are widely used and become essential parts in our daily lives. In addition to the working purposes, computers can be employed as amusement tools. With increasing development of computers, computer peripheral devices make great progress. Moreover, input devices play important roles in communicating computers and user. As known, a keyboard device is one of the most important input devices. Consequently, the manufacturers of keyboard device make efforts in designing novel keyboard devices with special functions in order to meet the requirements of different users.

Generally, a keyboard device comprises plural key structures. FIG. 1 is a schematic exploded view illustrating a conventional key structure. As shown in FIG. 1, the conventional key structure 1 comprises a keycap 11, a scissors-type connecting member 12, an elastic rubbery element 13, a switch circuit board 14, and a base plate 15. The keycap 11 may be depressed by a user. In addition, the keycap 11 is connected with the scissors-type connecting member 12. The scissors-type connecting member 12 comprises an inner frame 121 and an outer frame 122. The scissors-type connecting member 12 is connected with the keycap 11 and the base plate 15. The inner frame 121 has an inner frame shaft 1211. The outer frame 122 has an outer frame hole 1221 corresponding to the inner frame shaft 1211. After the inner frame shaft 1211 is inserted into the outer frame hole 1221, the inner frame 121 and the outer frame 122 are combined together. Consequently, the inner frame 121 is rotatable relative to the outer frame 122. The switch circuit board 14 is disposed on the base plate 15. The elastic rubbery element 13 is arranged between the keycap 11 and the switch circuit board 14. When the keycap 11 is depressed, the elastic rubbery element 13 is pushed by the keycap 11 and thus subject to deformation. Consequently, the switch circuit board 14 is triggered to generate a key signal. After the above components are combined together, the assembled key structure 1 is shown in FIG. 2.

However, since the elastic rubbery element 13 is made of a rubbery material, some drawbacks may occur. For example, during operation of the key structure 1, the elastic rubbery element 13 is pushed by the keycap 11 to be subject to deformation, and then the elastic rubbery element 13 is restored to an original state from the deformed state. Since the elastic rubbery element 13 is frequently and repeatedly subject to deformation and restored to the original state, the elastic rubbery element 13 made of the rubbery material is easily degraded or damaged. Under this circumstance, the elastic rubbery element needs to be replaced with a new one. As known, it is difficult for the user to disassemble the key structure and replace the elastic rubbery element.

Therefore, there is a need of providing a key structure with no elastic rubbery element in order to eliminate the above drawbacks.

SUMMARY OF THE INVENTION

The present invention provides a key structure with no elastic rubbery element.

In accordance with an aspect of the present invention, there is provided a key structure. The key structure includes a base plate, a switch circuit board, a keycap, and an enclosure frame. The switch circuit board is disposed on the base plate. When the switch circuit board is triggered, the switch circuit board generates a key signal. The keycap is disposed over the switch circuit board. When the keycap is depressed, the keycap is moved to trigger the switch circuit board. The keycap includes a magnetic element. The magnetic element is disposed on an edge part of the keycap for generating a magnetic force. The enclosure frame is disposed over the switch circuit board and connected with the keycap for stopping the keycap to be escaped from the enclosure frame. The enclosure frame has a magnetic coating layer. The magnetic coating layer is formed on an edge part of the enclosure frame and disposed over the magnetic element. In response to the magnetic force of the magnetic element, the magnetic coating layer is contacted with the magnetic element. When the keycap is depressed, the keycap is moved to trigger the switch circuit board. When the keycap is no longer depressed, the keycap is moved toward the magnetic coating layer and contacted with the enclosure frame in response to the magnetic force.

In accordance with another aspect of the present invention, there is provided a key structure. The key structure includes a base plate, a switch circuit board, a keycap, and an enclosure frame. The switch circuit board is disposed on the base plate. When the switch circuit board is triggered, the switch circuit board generates a key signal. The keycap is disposed over the switch circuit board. When the keycap is depressed, the keycap is moved to trigger the switch circuit board. The keycap includes a magnetic coating layer. The magnetic coating layer is disposed on an edge part of the keycap. The enclosure frame is disposed over the switch circuit board and connected with the keycap for stopping the keycap to be escaped from the enclosure frame. The enclosure frame has a magnetic element. The magnetic element is disposed on an edge part of the enclosure frame and disposed over the magnetic coating layer for generating a magnetic force. When the keycap is depressed, the keycap is moved to trigger the switch circuit board. When the keycap is no longer depressed, the keycap is moved toward the magnetic element and contacted with the enclosure frame in response to the magnetic force.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For eliminating the drawbacks encountered from the prior art, the present invention provides a key structure for a keyboard device. The keyboard device comprises plural key structures. In the following embodiments, only a single key structure will be illustrated.

Figure 1:
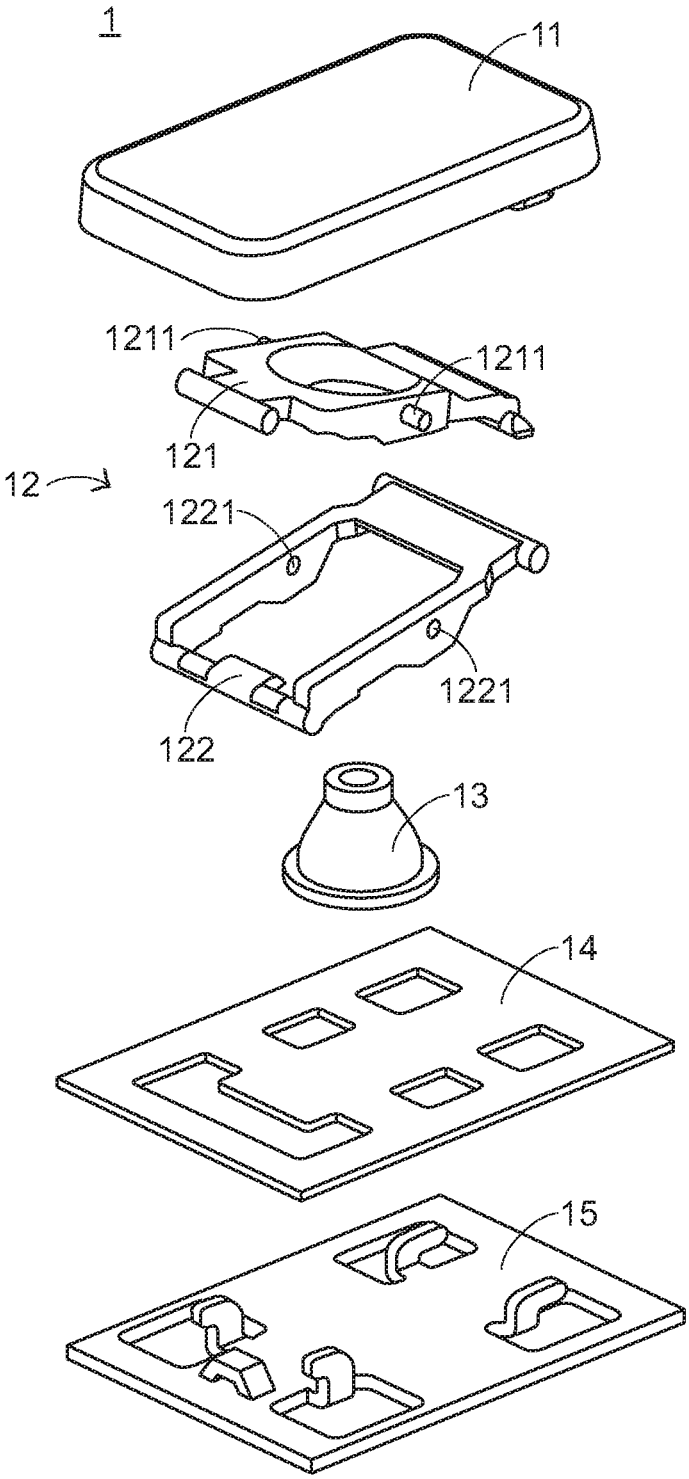
FIG.1 PRIOR ART
FIG. 1 is a schematic exploded view illustrating a conventional key structure.
Figure 2:
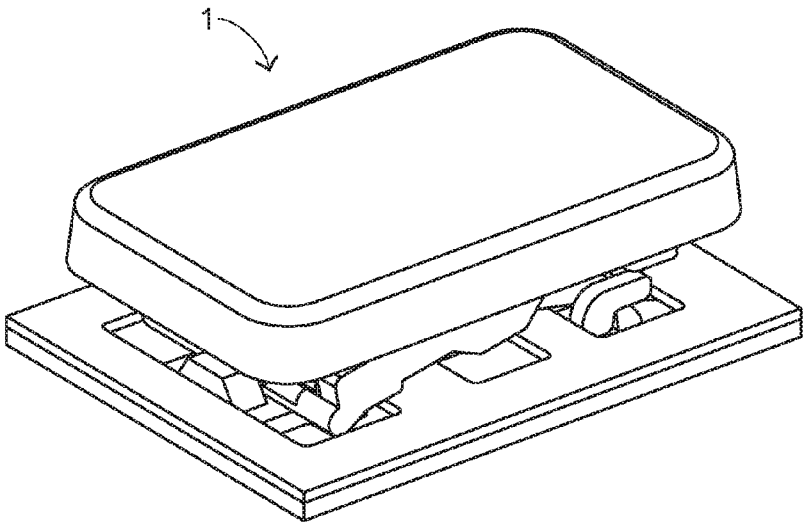
FIG.2 PRIOR ART
FIG. 2 is a schematic assembled view illustrating the key structure of FIG. 1.
Figure 3:
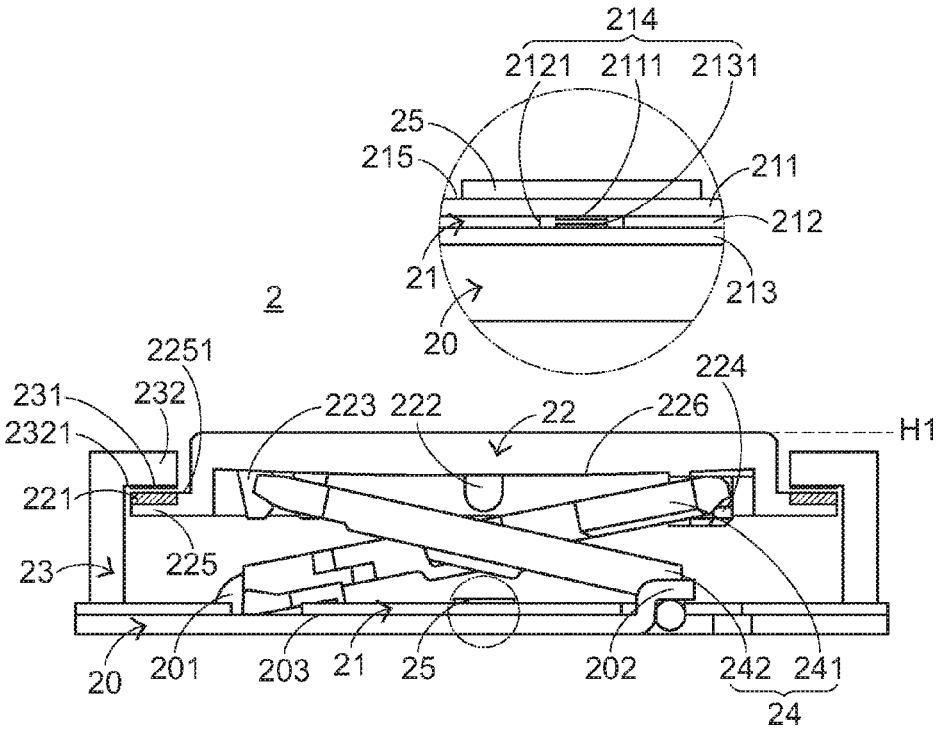
FIG. 3 is a schematic side view illustrating a key structure according to a first embodiment of the present invention.

FIG. 3 is a schematic side view illustrating a key structure according to a first embodiment of the present invention. As shown in FIG. 3, the key structure 2 comprises a base plate 20, a switch circuit board 21, a keycap 22, an enclosure frame 23, a connecting member 24, and a cushioning element 25. The base plate 20 is connected with the connecting member 24. In addition, the base plate 20 comprises a first fixing structure 201 and a second fixing structure 202. The first fixing structure 201 and the second fixing structure 202 are disposed on a top surface 203 of the base plate 20. The switch circuit board 21 is disposed on the base plate 20. When the switch circuit board 21 is triggered by the keycap 22, the switch circuit board 21 generates a corresponding key signal. In this embodiment, the switch circuit board 21 comprises an upper wiring board 211, a spacer layer 212, and a lower wiring board 213. The upper wiring board 211 has an upper contact 2111. The spacer layer 212 is disposed under the upper wiring board 211, and comprises a perforation 2121 corresponding to the upper contact 2111. When the switch circuit board 21 is depressed, the corresponding upper contact 2111 is inserted into the corresponding perforation 2121. The lower wiring board 213 is disposed under the spacer layer 212, and comprises a lower contact 2131 corresponding to the upper contact 2111. The lower contact 2131, the perforation 2121 and the upper contact 2111 are collectively defined as a key switch 214. In this embodiment, the switch circuit board 21 is a membrane switch circuit board.

The keycap 22 is disposed over the switch circuit board 21, and connected with the connecting member 24. When the keycap 22 is depressed, the keycap 22 is moved downwardly to trigger the switch circuit board 21. The keycap 22 comprises plural magnetic elements 221, a triggering part 222, a third fixing structure 223, and a fourth fixing structure 224. Each of the plural magnetic elements 221 is located at a top surface 2251 of an edge part 225 of the keycap 22 for generating a magnetic force. The triggering part 222 is disposed on a bottom surface 226 of the keycap 22. When the keycap 22 is depressed and moved downwardly, the key switch 214 of the switch circuit board 21 is triggered by the triggering part 222 so as to generate the key signal. The third fixing structure 223 and the fourth fixing structure 224 are both disposed on the bottom surface 226 of the keycap 22. In this embodiment, the magnetic elements 221 are magnets. The triggering part 222, the third fixing structure 223 and the fourth fixing structure 224 are integrally formed with the keycap 22. In addition, the keycap 22 is made of a plastic material.

Please refer to FIG. 3 again. The enclosure frame 23 is disposed over the switch circuit board 21 and contacted with the edge part 225 of the keycap 22 for stopping the keycap 22 to be escaped from the enclosure frame 23. The enclosure frame 23 comprises plural magnetic coating layers 231. Each of the magnetic coating layers 231 is formed on a bottom surface 2321 of an edge part 232 of the enclosure frame 23 and disposed over the corresponding magnetic element 221. In case that the magnetic coating layer 231 is magnetically attracted by the magnetic force of the corresponding magnetic element 221, the magnetic coating layer 231 is contacted with the corresponding magnetic element 221. The connecting member 24 is arranged between the base plate 20 and the keycap 22. The connecting member 24 is used for connecting the base plate 20 and the keycap 22 and supporting the keycap 22. In this embodiment, the connecting member 24 comprises a first frame 241 and a second frame 242. A first end of the first frame 241 is connected with the first fixing structure 201, and a second end of the first frame 241 is connected with the fourth fixing structure 224. After the second frame 242 and the first frame 241 are combined together, the connecting member 24 is in an open-scissors state (see FIG. 3) or a folded state (see FIG. 4). A first end of the second frame 242 is connected with the third fixing structure 223, and a second end of the second frame 242 is connected with the second fixing structure 202. Consequently, the connecting member 24 is connected with the keycap 22 and the base plate 20. In this embodiment, each of the magnetic coating layers 231 is produced by coating a metallic material on the bottom surface 2321 of the edge part 232 of the enclosure frame 23. In addition, the connecting member 24 is a scissors-type connecting member.

The cushioning element 25 is disposed on a top surface 215 of the upper wiring board 211 of the switch circuit board 21, and disposed under the triggering part 222. When the triggering part 222 is contacted with the cushioning element 25, an impact force resulting from the triggering part 222 is absorbed by the cushioning element 25. Consequently, the switch circuit board 21 is protected by the cushioning element 25. In this embodiment, the cushioning element 25 is made of a soft material.

By the way, since the keycap 22 is fixed on the base plate 20 through the connecting member 24, the height of the keycap 22 may be limited by the connecting member 24. Moreover, since the plural edges 232 of the enclosure frame 23 and the plural edge parts 225 of the plural keycap 22 are contacted with each other, the height of the keycap 22 is further limited by the enclosure frame 23. That is, if the arrangements of the connecting member 24 and the enclosure frame 23 are changed, the travelling distance of depressing the keycap 22 and the tactile feel sensed by the user may be adjusted in order to meet the user's requirements.

Figure 4:
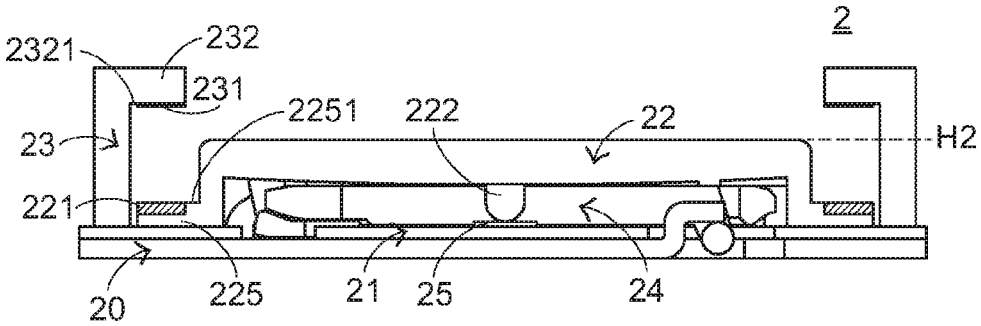
FIG. 4 is a schematic side view illustrating the key structure according to the first embodiment of the present invention, in which the keycap is depressed.

Hereinafter, the operations of the key structure 2 will be illustrated with reference to FIGS. 3 and 4. FIG. 4 is a schematic side view illustrating the key structure according to the first embodiment of the present invention, in which the keycap is depressed. As shown in FIG. 3, the keycap 22 has not been depressed. Under this circumstance, the connecting member 24 is in the open-scissors state, and the keycap 22 is located at a first height H1. In addition, the keycap 22 is contacted with the enclosure frame 23, and the magnetic coating layers 231 are magnetically attracted by respective magnetic elements 221. When the keycap 22 is depressed by the user, the depressing force acting on the keycap 22 is larger than the magnetic force. Consequently, the keycap 22 is separated from the enclosure frame 23 and moved toward the switch circuit board 21. Under this circumstance, the connecting member 24 is switched from the open-scissors state to the folded state (see FIG. 4). Moreover, the triggering part 222 of the keycap 22 is moved downwardly to be contacted with the cushioning element 25, and the key switch 214 of the switch circuit board 21 is triggered by the triggering part 222 to generate a key signal. On the other hand, the impact force resulting from the triggering part 222 is absorbed by the cushioning element 25. Consequently, the damage of the switch circuit board 21 caused by collision will be minimized or eliminated. Under this circumstance, the keycap 22 is located at a second height H2, wherein the second height H2 is lower than the first height H1.

When the keycap 22 is no longer depressed by the user, the depressing force acting on the keycap 22 is eliminated. Consequently, the magnetic coating layer 231 on the enclosure frame 23 is magnetically attracted by the magnetic force of the magnetic element 221. Since the enclosure frame 23 is fixed and immobile, in response to the magnetic force, the keycap 22 will be moved toward the magnetic coating layer 231 until the keycap 22 is contacted with the enclosure frame 23. Under this circumstance, the keycap 22 is returned to the position corresponding to the first height H1 (see FIG. 3).

Figure 5:
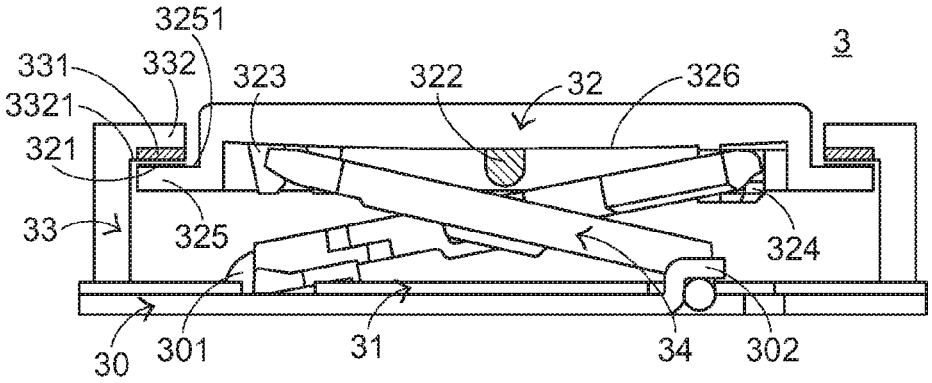
FIG. 5 is a schematic side view illustrating a key structure according to a second embodiment of the present invention.

The present invention further provides a second embodiment of a key structure. FIG. 5 is a schematic side view illustrating a key structure according to a second embodiment of the present invention. As shown in FIG. 5, the key structure 3 comprises a base plate 30, a switch circuit board 31, a keycap 32, an enclosure frame 33, and a connecting member 34. The base plate 30 comprises a first fixing structure 301 and a second fixing structure 302. The keycap 32 comprises plural magnetic coating layers 321, a triggering part 322, a third fixing structure 323, and a fourth fixing structure 324. The enclosure frame 33 comprises plural magnetic elements 332. The plural magnetic elements 332 are disposed on plural edge parts 332 of the enclosure frame 33. Except for the following two items, the configurations of the key structure 3 of this embodiment are substantially identical to those of the key structure 2 of the first embodiment, and are not redundantly described herein.

Firstly, the cushioning element which is made of the soft material is not included in the key structure 3. In this embodiment, the triggering part 322 is disposed on a bottom surface 326 of the keycap 32, and the triggering part 322 is made of a soft material. When the triggering part 322 is contacted with the switch circuit board 31, a generated impact force is absorbed by the triggering part 322. Consequently, the switch circuit board 31 is protected by the triggering part 322.

Secondly, each of the plural magnetic coating layers 321 is formed on a top surface 3251 of the edge part 325 of the keycap 32. In addition, each of the magnetic coating layers 321 is produced by coating a metallic material on the top surface 3251 of the edge part 325 of the keycap 32. On the other hand, the enclosure frame 33 comprises plural magnetic elements 331. Each of the plural magnetic elements 331 is disposed on a bottom surface 3321 of an edge part 322 of the enclosure frame 33, and disposed over the corresponding magnetic coating layer 321. The operations of the key structure 3 of this embodiment are substantially identical to those of the key structure 2 of the first embodiment, and are not redundantly described herein.

Figure 6:
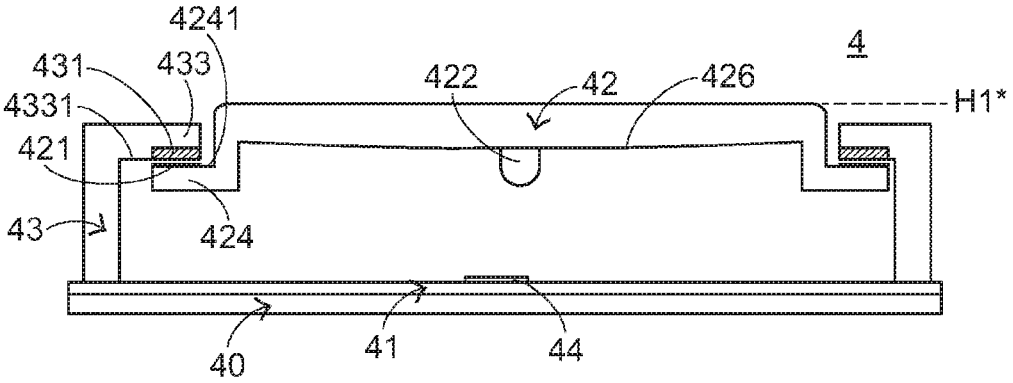
FIG. 6 is a schematic side view illustrating a key structure according to a third embodiment of the present invention.

The present invention further provides a third embodiment of a key structure. FIG. 6 is a schematic side view illustrating a key structure according to a third embodiment of the present invention. As shown in FIG. 6, the key structure 4 comprises a base plate 40, a switch circuit board 41, a keycap 42, an enclosure frame 43, and a cushioning element 44. The switch circuit board 41 is disposed on the base plate 40. When the switch circuit board 41 is triggered by the keycap 42, the switch circuit board 41 generates a corresponding key signal. Similarly, the switch circuit board 41 comprises an upper wiring board, a spacer layer, and a lower wiring board. The configurations and the operations of the switch circuit board 41 of the key structure 4 of this embodiment are substantially identical to those of the switch circuit board 21 of the key structure 2 of the first embodiment, and are not redundantly described herein.

Figure 7:
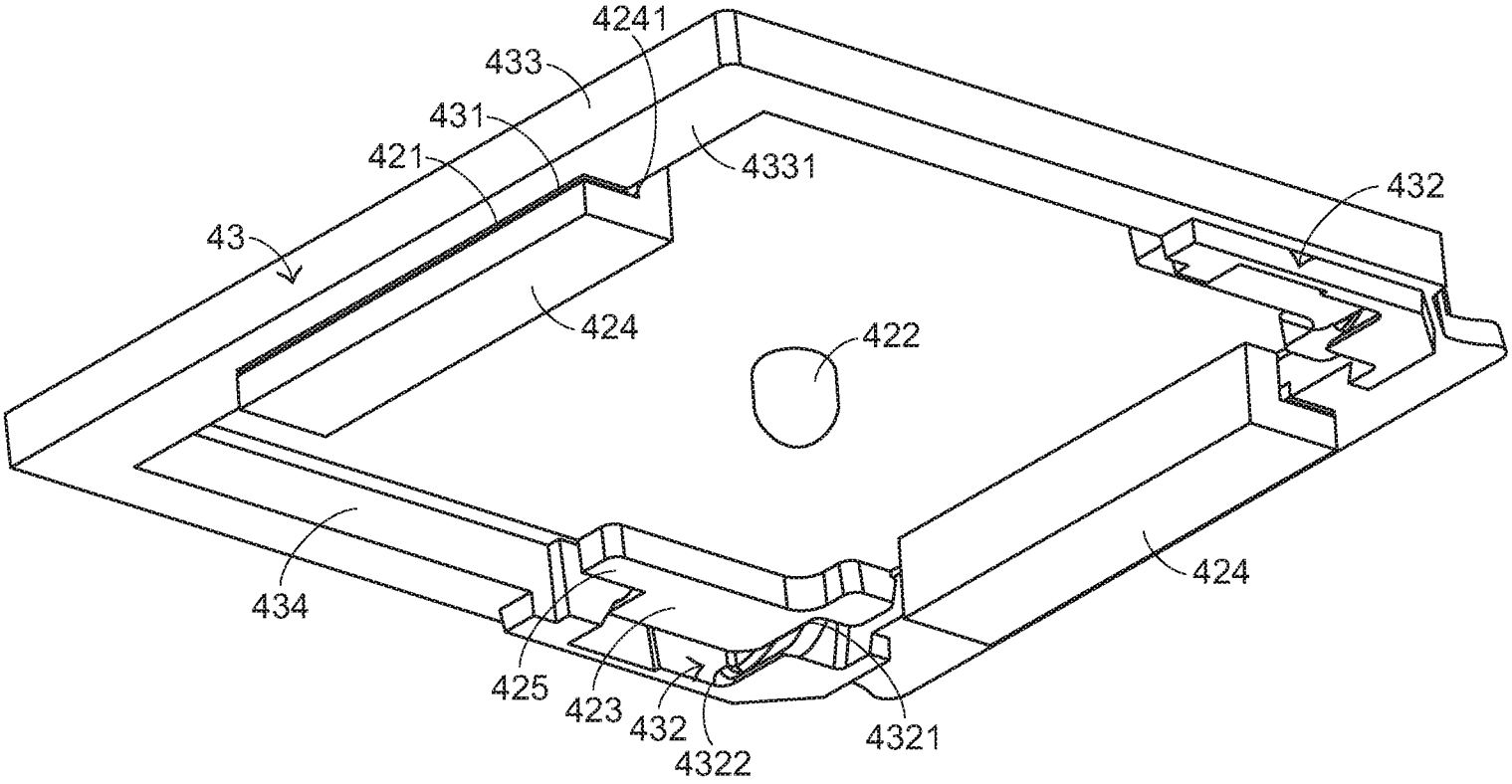
FIG. 7 is a schematic perspective view illustrating the key structure according to the third embodiment of the present invention and taken along another viewpoint.

Please refer to FIGS. 6 and 7. FIG. 7 is a schematic perspective view illustrating the key structure according to the third embodiment of the present invention and taken along another viewpoint. The keycap 42 is supported by the enclosure frame 43, and disposed over the switch circuit board 41. When the keycap 42 is depressed, the keycap 42 is moved downwardly to trigger the switch circuit board 41. The keycap 42 comprises plural magnetic coating layers 421, a triggering part 422, and plural inclined protrusion blocks 423. Each of the plural magnetic coating layers 421 is disposed on a top surface 4241 of a first edge part 424 of the keycap 42. The triggering part 422 is disposed on a bottom surface 426 of the keycap 42. When the keycap 42 is depressed and moved, the switch circuit board 41 is triggered by the triggering part 422 to generate the key signal. Each of the plural inclined protrusion blocks 423 is disposed on a second edge part 425 of the keycap 42. In this embodiment, each of the magnetic coating layers 421 is produced by coating a metallic material on the top surface 4241 of the first edge part 424 of the keycap 42. The triggering part 422 and the plural inclined protrusion blocks 423 are integrally formed with the keycap 42. Moreover, the keycap 42 is made of a plastic material.

The enclosure frame 43 is disposed over the switch circuit board 41 and contacted with the first edge part 424 of the keycap 42 for stopping the keycap 42 to be escaped from the enclosure frame 43. The enclosure frame 43 comprises plural magnetic elements 431 and plural inclined guiding recesses 432. Each of the plural magnetic elements 431 is disposed on a bottom surface 4331 of an edge part 433 of the enclosure frame 43 and disposed over the corresponding magnetic coating layer 421. The magnetic elements 431 are used for generating a magnetic force. The plural inclined guiding recesses 432 are formed in plural sidewalls 434 of the enclosure frame 43. In addition, the plural inclined guiding recesses 432 are aligned with respective inclined protrusion blocks 423. Consequently, the inclined protrusion blocks 423 are inserted into corresponding inclined guiding recesses 432 and contacted with the inclined guiding recesses 432. After the inclined protrusion blocks 423 are inserted into corresponding inclined guiding recesses 432, the keycap 42 is supported by the enclosure frame 43 to be positioned over the switch circuit board 41. In this embodiment, the magnetic element 431 is a magnet.

The cushioning element 44 is disposed on a top surface 415 of the switch circuit board 41, and disposed under the triggering part 422. When the triggering part 422 is contacted with the cushioning element 44, an impact force resulting from the triggering part 422 is absorbed by the cushioning element 44. Consequently, the switch circuit board 41 is protected by the cushioning element 44. In this embodiment, the cushioning element 44 is made of a soft material.

Figure 8:
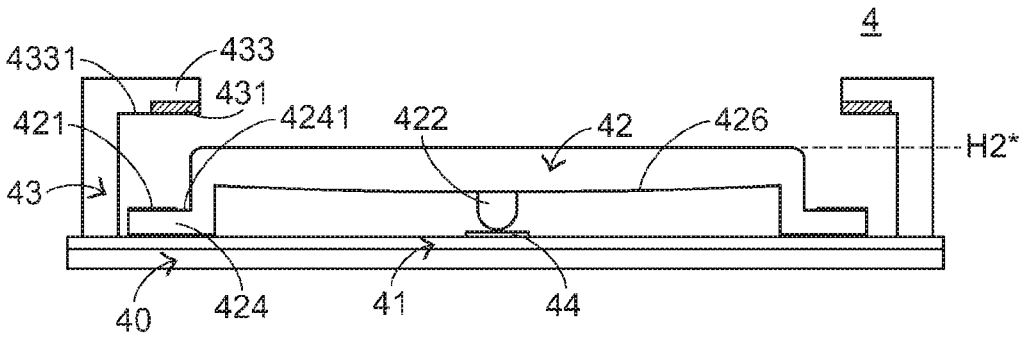
FIG. 8 is a schematic side view illustrating the key structure according to the third embodiment of the present invention, in which the keycap is depressed.

Hereinafter, the operations of the key structure 4 will be illustrated with reference to FIGS. 6, 7 and 8. FIG. 8 is a schematic side view illustrating the key structure according to the third embodiment of the present invention, in which the keycap is depressed. As shown in FIGS. 6 and 7, the keycap 42 has not been depressed. Under this circumstance, the inclined protrusion block 423 of the keycap 42 is contacted with a first end 4321 of the corresponding inclined guiding recess 432, so that the keycap 42 is located at a first height H1*. In addition, the magnetic coating layers 421 are magnetically attracted by respective magnetic elements 431. When the keycap 42 is depressed by the user, the depressing force acting on the keycap 42 is larger than the magnetic force. Consequently, the first edge part 424 of the keycap 42 is separated from the edge part 433 of the enclosure frame 43, and the inclined protrusion block 423 on the second edge part 425 of the keycap 42 is slid within the corresponding inclined guiding recess 432. In addition, the triggering part 422 of the keycap 42 is moved downwardly to be contacted with the cushioning element 44, and the switch circuit board 41 is triggered by the triggering part 422 to generate a key signal. On the other hand, the impact force resulting from the triggering part 422 is absorbed by the cushioning element 44. Consequently, the damage of the switch circuit board 41 caused by collision will be minimized or eliminated. Under this circumstance, the keycap 42 is located at a second height H2* (see FIG. 8), wherein the second height H2* is lower than the first height H1*. Moreover, the inclined protrusion block 423 of the keycap 42 is contacted with a second end 4322 of the corresponding inclined guiding recess 432.

When the keycap 42 is no longer depressed by the user, the depressing force acting on the keycap 42 is eliminated. Consequently, the magnetic coating layer 421 on the keycap 42 is magnetically attracted by the magnetic force of the magnetic element 431. In response to the magnetic force, the keycap 42 will be moved toward the magnetic element 431 until the first edge part 424 of the keycap 42 is contacted with the edge part 433 of the enclosure frame 43. Under this circumstance, the keycap 42 is returned to the position corresponding to the first height H1* (see FIG. 6).

By the way, since the key structure 4 of this embodiment has no connecting member, the keycap 42 is not fixed on the base plate 40. In the key structure 4 of this embodiment, the keycap 42 is supported by the inclined guiding recesses 432 of the enclosure frame 43, so that the keycap 42 is positioned over the switch circuit board 41. Moreover, since the plural edge parts 431 of the enclosure frame 43 are disposed over the first edge part 424 of the keycap 42, the keycap 42 is detached from the enclosure frame 43, and the keycap 42 is fixed within the enclosure frame 43. Since the plural inclined protrusion blocks 423 of the keycap 42 are supported by the inclined guiding recesses 432, when the keycap 42 is depressed by the user, the inclined guiding recesses 432 are continuously contacted with the plural inclined protrusion blocks 423. Consequently, during the process of depressing the keycap 42 by the user, the continuous contact between the inclined guiding recesses 432 and the plural inclined protrusion blocks 423 may provide a tactile feel. The tactile feel sensed by the user is close to the tactile feel provided by the elastic rubbery element. Consequently, when the key structure of the present invention is operated by the user, the user can feel a familiar tactile feel. That is, the tactile feel is not strange to the user.

Figure 9:
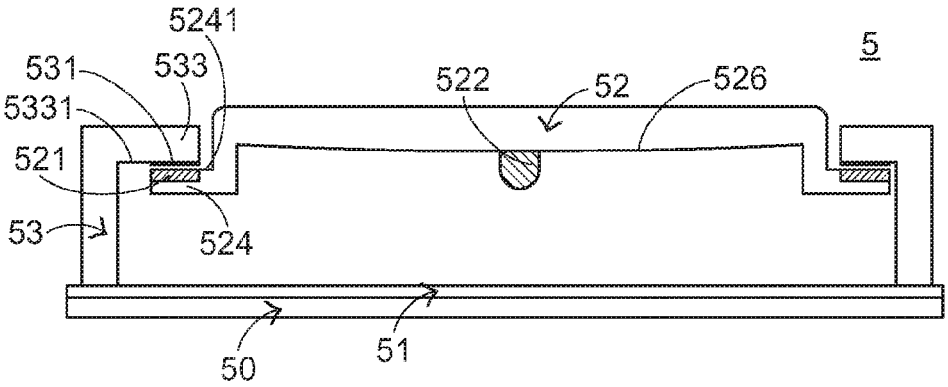
FIG. 9 is a schematic side view illustrating a key structure according to a fourth embodiment of the present invention.

The present invention further provides a fourth embodiment of a key structure. FIG. 9 is a schematic side view illustrating a key structure according to a fourth embodiment of the present invention. As shown in FIG. 9, the key structure 5 comprises a base plate 50, a switch circuit board 51, a keycap 52, and an enclosure frame 53. The keycap 52 comprises plural magnetic elements 521, a triggering part 522, and plural inclined protrusion blocks (not shown). The enclosure frame 53 comprises plural magnetic coating layers 531 and plural inclined guiding recesses (not shown). Except for the following two items, the configurations of the key structure 5 of this embodiment are substantially identical to those of the key structure 4 of the third embodiment, and are not redundantly described herein.

Firstly, the cushioning element made of the soft material is not included in the key structure 5. In this embodiment, the triggering part 522 is disposed on a bottom surface 526 of the keycap 52, and the triggering part 522 is made of a soft material. When the triggering part 522 is contacted with the switch circuit board 51, a generated impact force is absorbed by the triggering part 522. Consequently, the switch circuit board 51 is protected by the triggering part 522.

Secondly, each of the plural magnetic elements 521 is disposed on a top surface 5241 of a first edge part 524 of the keycap 52. Moreover, the enclosure frame 53 comprises plural magnetic coating layers 531. Each of the magnetic coating layers 531 is formed on a bottom surface 5321 of an edge part 532 of the enclosure frame 53, and disposed over the corresponding magnetic element 521. Each of the magnetic coating layers 531 is produced by coating a metallic material on the bottom surface 5321 of an edge part 532 of the keycap 53. The operations of the key structure 5 of this embodiment are substantially identical to those of the key structure 4 of the third embodiment, and are not redundantly described herein.

From the above embodiments, it is found that the easily-damage elastic rubbery element is not included in the key structure of the present invention. Moreover, the triggering part for triggering the switch circuit board is disposed on the bottom surface of the keycap. The magnetic element is disposed on the keycap, and the magnetic coating layer corresponding to the magnetic element is formed on the enclosure frame. Alternatively, the magnetic element is disposed on the enclosure frame, and the magnetic coating layer corresponding to the magnetic element is formed on the keycap. After the depressing force acting on the keycap is eliminated, in response to the magnetic force generated by the magnetic force, the keycap is returned to the original position where the keycap is not depressed. Consequently, by using the key structure of the present invention, the problem of causing damage of the elastic rubbery element is avoided, and it is not necessary to replace the elastic rubbery element.

Moreover, due to the cooperation between the inclined guiding recesses of the enclosure frame and the inclined protrusion blocks of the keycap and the cooperation between the magnetic element and the magnetic coating layer, the tactile feel sensed by the user is close to the tactile feel provided by the elastic rubbery element. Consequently, the operation of the key structure of the present invention is user-friendly. On the other hand, during the process of depressing the key structure of the present invention, the keycap is moved upwardly or downwardly or the keycap is moved obliquely in the upward or downward direction. Moreover, since the magnetic element is disposed over the magnetic coating layer or the magnetic coating layer is disposed over the magnetic element, the distance between the magnetic element and the magnetic coating layer is relative closer. Moreover, since the direction of arranging the magnetic element and the magnetic coating layer is the same as or close to the moving direction of the keycap, the magnetic force generated by the magnetic force can provide better attracting efficacy so as to facilitate movement of the keycap.

Moreover, in the key structure of the present invention, the magnetic element has to be installed in one of the keycap and the enclosure frame only. That is, a space for accommodating the magnetic element has to be installed in a single element only (e.g. the keycap), but the magnetic coating layer is formed on the other element (e.g. the enclosure frame). As a consequence, the key structure of the present invention has reduced fabricating cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure, comprising:

a base plate;

a switch circuit board disposed on the base plate, wherein when the switch circuit board is triggered, the switch circuit board generates a key signal;

a keycap disposed over the switch circuit board, wherein when the keycap is depressed, the keycap is moved to trigger the switch circuit board, wherein the keycap comprises a magnetic element, and the magnetic element is disposed on an edge part of the keycap for generating a magnetic force; and an enclosure frame disposed over the switch circuit board and connected with the keycap for stopping the keycap to be escaped from the enclosure frame, wherein the enclosure frame has a magnetic coating layer, and the magnetic coating layer is formed on an edge part of the enclosure frame and disposed over the magnetic element, wherein in response to the magnetic force of the magnetic element, the magnetic coating layer is contacted with the magnetic element, wherein when the keycap is depressed, the keycap is moved to trigger the switch circuit board, wherein when the keycap is no longer depressed, the keycap is moved toward the magnetic coating layer and contacted with the enclosure frame in response to the magnetic force, wherein the enclosure frame further comprises an inclined guiding recess, and the inclined guiding recess is formed in a sidewall of the enclosure frame, wherein the keycap further comprises an inclined protrusion block, and the inclined protrusion block is disposed on another edge part of the keycap and inserted into the inclined guiding recess and contacted with the inclined guiding recess, wherein when the keycap is not depressed, the inclined protrusion block is supported by the inclined guiding recess, so that the keycap is located at a first height, wherein when the keycap is depressed, the inclined protrusion block is slid within the inclined guiding recess, so that the keycap is located at a second height, wherein the second height is lower than the first height.

2. The key structure according to claim 1, wherein the keycap further comprises a triggering part, and the triggering part is disposed on a bottom surface of the keycap, wherein when the keycap is depressed and moved, the switch circuit board is triggered by the triggering part to generate the key signal.

3. The key structure according to claim 2, wherein the key structure further comprises a cushioning element, wherein the cushioning element is disposed on atop surface of the switch circuit board and disposed under the triggering part, wherein when the triggering part is contacted with the cushioning element, an impact force resulting from the triggering part is absorbed by the cushioning element, so that the switch circuit board is protected, wherein the triggering part is integrally formed with the keycap, and the cushioning element is made of a soft material.

4. The key structure according to claim 2, wherein the triggering part is made of a soft material, wherein when the triggering part is contacted with the switch circuit board, a generated impact force is absorbed by the triggering part, so that the switch circuit board is protected.

5. The key structure according to claim 1, wherein the key structure further comprises a connecting member, and the connecting member is arranged between the base plate and the keycap for connecting the base plate and the keycap and supporting the keycap, wherein when the keycap is not depressed, the connecting member is an open-scissors state, and the keycap is located at a first height, wherein when the keycap is depressed, the connecting member is switched from the open-scissors state to a folded state, and the keycap is located at a second height, wherein the second height is lower than the first height.

6. A key structure, comprising:

a base plate;

a switch circuit board disposed on the base plate, wherein when the switch circuit board is triggered, the switch circuit board generates a key signal;

a keycap disposed over the switch circuit board, wherein when the keycap is depressed, the keycap is moved to trigger the switch circuit board, wherein the keycap comprises a magnetic coating layer, and the magnetic coating layer is disposed on an edge part of the keycap; and an enclosure frame disposed over the switch circuit board and connected with the keycap for stopping the keycap to be escaped from the enclosure frame, wherein the enclosure frame has a magnetic element, and the magnetic element is disposed on an edge part of the enclosure frame and disposed over the magnetic coating layer for generating a magnetic force, wherein when the keycap is depressed, the keycap is moved to trigger the switch circuit board, wherein when the keycap is no longer depressed, the keycap is moved toward the magnetic element and contacted with the enclosure frame in response to the magnetic force, wherein the enclosure frame further comprises an inclined guiding recess, and the inclined guiding recess is formed in a sidewall of the enclosure frame, wherein the keycap further comprises an inclined protrusion block, and the inclined protrusion block is disposed on another edge part of the keycap and inserted into the inclined guiding recess and contacted with the inclined guiding recess, wherein when the keycap is not depressed, the inclined protrusion block is supported by the inclined guiding recess, so that the keycap is located at a first height, wherein when the keycap is depressed, the inclined protrusion block is slid within the inclined guiding recess, so that the keycap is located at a second height, wherein the second height is lower than the first height.

7. The key structure according to claim 6, wherein the keycap further comprises a triggering part, and the triggering part is disposed on a bottom surface of the keycap, wherein when the keycap is depressed and moved, the switch circuit board is triggered by the triggering part to generate the key signal.

8. The key structure according to claim 7, wherein the key structure further comprises a cushioning element, wherein the cushioning element is disposed on a top surface of the switch circuit board and disposed under the triggering part, wherein when the triggering part is contacted with the cushioning element, an impact force resulting from the triggering part is absorbed by the cushioning element, so that the switch circuit board is protected, wherein the triggering part is integrally formed with the keycap, and the cushioning element is made of a soft material.

9. The key structure according to claim 7, wherein the triggering part is made of a soft material, wherein when the triggering part is contacted with the switch circuit board, a generated impact force is absorbed by the triggering part, so that the switch circuit board is protected.

10. The key structure according to claim 6, wherein the key structure further comprises a connecting member, and the connecting member is arranged between the base plate and the keycap for connecting the base plate and the keycap and supporting the keycap, wherein when the keycap is not depressed, the connecting member is in an open-scissors state, and the keycap is located at a first height, wherein when the keycap is depressed, the connecting member is switched from the open-scissors state to a folded state, and the keycap is located at a second height, wherein the second height is lower than the first height.

* * * * *